US005782698A

United States Patent [19]

Keller

[11] Patent Number: 5,782,698

[45] Date of Patent: Jul. 21, 1998

[54] OPTICAL ILLUSION DEVICE

[76] Inventor: Allan Keller, 358 Nagel Avenue, Orleans, Ottawa, Ontario, Canada, K1E 1R6

[21] Appl. No.: 628,279

[22] Filed: Apr. 5, 1996

[51] Int. Cl.[6] ..... A63J 5/02

[52] U.S. Cl. ..... 472/61; 472/63; 40/427

[58] Field of Search ..... 472/61, 63, 72; 40/427, 442, 607

[56] References Cited

U.S. PATENT DOCUMENTS

| | | | |
|---|---|---|---|
| 946,669 | 1/1910 | Gill et al. | 40/427 X |
| 1,466,107 | 8/1923 | Aloe . | |
| 2,334,750 | 11/1943 | Cerrachio . | |
| 2,399,121 | 4/1946 | Janson | 472/70 |
| 2,565,553 | 8/1951 | Foley . | |
| 2,663,960 | 12/1953 | Cerracchio | 472/61 X |
| 3,868,283 | 2/1975 | Scheyer . | |
| 4,180,930 | 1/1980 | DiMatteo . | |
| 4,277,139 | 7/1981 | Cox . | |
| 4,347,270 | 8/1982 | Hart . | |
| 4,565,022 | 1/1986 | Chapin | 40/442 |
| 4,927,686 | 5/1990 | Colea . | |
| 5,363,159 | 11/1994 | Melvin . | |
| 5,407,391 | 4/1995 | Monroe et al. . | |

OTHER PUBLICATIONS

Brochure "Giftionery Taipei '96", Apr. 12, 1996, Issue No. 3, Taipei International Gift & Stationery Spring Show, Apr. 10–13, 1996 including Spooky sights From Vision Quest article by Francis Huang.

Brochure"Virtual Holographic Motion Sculptures", Lian Shin Craft Enterprise Co., Ltd.

*Primary Examiner*—Kien T. Nguyen

*Attorney, Agent, or Firm*—Gary M. Nath; Greg B. Kang; Nath & Associates

[57] ABSTRACT

This optical illusion device is of the type which has a sculpted or relief image-forming surface resembling in shape a negative of the object whose image is to appear when the image-forming surface is viewed. The device is improved to yield a more attractive image by providing altered shading to the negative image-forming surface. The contour of the image forming surface is exposed or unframed to provide a free standing contour. The relief of the image-forming surface is altered to control shadowing when illuminated from a predetermined illumination angle. The substrate on which the image-forming surface is provided is similarly sculpted in detail on an opposite side to provide both a visually appealing sculpture as well as a good image providing surface on the negative, and the substrate is mounted for viewing from either side. The image-forming surface has a main image portion and at least one peripheral image portion with an outer edge of the peripheral portion being shaped to hide the peripheral portion when viewed from an extreme angle at which the image of the peripheral portion should not be part of the image seen. The image-forming negative surface may be translucent, and a surrounding frame member connected to the front edge of the negative surface guides light from the rear onto a rear side of the negative translucent surface while providing a rear mounting surface.

17 Claims, 4 Drawing Sheets

10

15a
11
2a
2a
2b
2b
15b
16

16
15g
15d
15e
11
15d
30
35
18
31

OPTICAL ILLUSION DEVICE

FIELD OF THE INVENTION

The present invention relates to an optical illusion device of the type which comprises a sculpted or relief image-forming surface which resembles in shape a negative of the object whose image is to appear when the image-forming surface is viewed.

BACKGROUND OF THE INVENTION

It is known in the art to provide a negative of sculpture resembling a person or the concave surface of a death mask to provide an optical illusion of a three-dimensional image of the person represented by the relief in the negative or the death mask. Such devices are known from U.S. Pat. No. 2,334,750 granted to Enrico Cerrachio on Nov. 23, 1943. In Cerrachio, a clay death mask is mounted in a housing having a front viewing window and a lamp illuminating the negative side of the mask. The positive side of the mask is enclosed in the housing. When viewed, the image seen is not the form of the negative mold or death mask, but rather a "positive" three-dimensional image of the person's face originally used to form the mask, resulting from an optical illusion. The image also moves with the viewing angle, such that viewing the device from the right presents an image of the left side of the face, and vice versa. This gives the effect that the image follows the viewer, and this is so particularly in the case of a death mask, since the eyes of the image turn in the direction of the viewing angle change.

More recently, it is known from U.S. Pat. No. 5,407,391, granted to Monroe et al. and assigned to the Walt Disney Company, to provide a negative translucent bust on which an image is rear projected to provide the illusion of a three-dimensional image of a bust having the coloration of the projected image. To facilitate image focus on the bust, and to improve viewing angle, the normal depth of the bust is flattened with respect to the original. In Monroe et al, the bust is used only for basic facial features. Features which surround the face, such as hair and ears, are imaged on the flat part of the translucent material surrounding the bust. Such features would thus lose the appearance of being three-dimensional since they are not formed on a negative image-forming relief surface.

SUMMARY OF THE INVENTION

It is an object of the present invention to improve upon the prior art optical illusion devices in ways which significantly improve the image sharpness and realness, as well as enhance the overall viewing enjoyment.

The invention provides the following improvements:

1) Altered shading: The negative image-forming relief surface is provided with a shading coloration on its surface in such a way that portions of the surface which are more recessed are generally made lighter in shade and portions of the surface which are less recessed are generally made darker in shade. This results in perception of a three-dimensional image which is enhanced without generating in the image perceived any shade variation artifacts, which would make the image appear to have a different shading than the real object.

2) Free Standing Contour: The negative image-forming relief surface has a peripheral edge and the negative is mounted such that the peripheral edge is substantially exposed. The peripheral edge appears non-obstructive to a perception of an image coming from the negative image-forming relief surface when viewed substantially obliquely. The image coming from the surface appears substantially free of a surrounding frame and maintains its own contour.

3) Illumination Entry Angle Altered Depth: A light source projects light onto the negative image-forming surface from a position substantially unobstructive to viewing the surface from a predetermined angle. The negative image-forming surface is formed in an altered manner to substantially control light shadows on the image-forming surface resulting from the light source being blocked by some parts of the surface and reaching others. The light source is thereby able to illuminate the negative image-forming surface with proper controlled shadows.

4) Full Sculpture: The negative image-forming surface is provided on an opposite side of a detailed positive sculpture which is mounted on a display mount for viewing both the image-forming negative surface and the positive sculpture surface.

5) Double concave: The negative image-forming surface has a main portion and a peripheral portion which together provide a composite image when viewed from moderate angles in a viewing plane. The main portion has a maximum image viewing angle in the viewing plane when viewed from a side of the negative surface on which the peripheral portion is located. By giving the outer edge of the peripheral portion a predetermined relief with respect to the edge of the main portion adjacent to the peripheral portion, an image of the peripheral portion when viewed from the maximum image viewing angle is substantially blocked. Using a double concave negative, it is possible to create an image of a person's face and surrounding hair and/or ears. As the viewing angle changes, the peripheral image moves like the main image and is eclipsed by the peripheral edge in a natural way.

6) Rear Mounting: The negative image-forming surface is made of a translucent material and has a frame means connected to a periphery of thereof for providing a regular rear mounting surface and for guiding light from a rear onto the negative surface. This feature facilitates rear mounting of the device. The frame means may be shaped to mount to a window or a lamp. The back of the frame means may also be closed and illumination may be provided by a lamp provided within the frame means.

According to one aspect of the invention, there is provided an optical illusion device comprising: a substrate having a negative image-forming surface; and a shading coloration applied to the surface, the coloration corresponding to a shape of the negative image-forming surface such that portions of the surface which are more recessed are generally made lighter in shade and portions of the surface which are less recessed are generally made darker in shade, whereby perception of a three-dimensional image is enhanced without generating shade variation artifacts in the image perceived.

According to a further broad aspect of the invention, there is provided an optical illusion device comprising: a substrate having a negative image-forming surface and an opposed corresponding positive image-sculpted surface; and a display mount means for mounting the substrate such that the negative surface and the positive surface can be viewed.

According to a still further broad aspect of the invention, there is provided an optical illusion device comprising: a substrate having a negative image-forming surface and a peripheral edge means; and means for mounting the substrate such that the edge means is substantially exposed; the peripheral edge means appearing non-obstructive to a perception of an image coming from the surface when viewed substantially obliquely, whereby the image coming from the surface appears substantially free of a surrounding frame and maintains its own contour.

According to a still further broad aspect of the invention, there is provided an optical illusion device comprising: a substrate having a negative image-forming surface; and a light source for projecting light onto the surface from a position substantially unobstructive to viewing the surface from a predetermined angle; wherein: the negative surface is formed in an altered manner to control light shadows resulting from light from the light source being blocked by parts of the surface from reaching other parts of the surface, whereby the light source illuminates the surface with controlled shadows.

According to yet a further broad aspect of the invention, there is provided an optical illusion device comprising: a substrate having a negative image-forming surface comprising a main portion and a peripheral portion, the main and peripheral portions providing a composite image when viewed from moderate angles in a viewing plane; wherein: the peripheral portion has an edge with respect to a periphery of the surface; the main portion has an edge with respect to the peripheral portion and a maximum image viewing angle in the plane when viewed from a side of the surface on which said peripheral portion is located; and the edge of the peripheral portion has a relief with respect to the edge of the main portion so as to block substantially an image of the peripheral portion when viewed from the maximum image viewing angle.

According to a still further broad aspect of the present invention, there is provided an optical illusion device comprising: a substrate having a negative image-forming translucent surface; and a frame means connected to a periphery of the negative image-forming surface of the substrate for providing a regular rear mounting surface and for guiding light from a rear onto the negative surface, whereby rear mounting of the device is facilitated.

BRIEF DESCRIPTION OF THE DRAWINGS

The invention will be better understood by way of the following detailed description of a preferred embodiment with reference to the appended drawings, in which.

DETAILED DESCRIPTION OF THE PREFERRED EMBODIMENT

Figure 1:
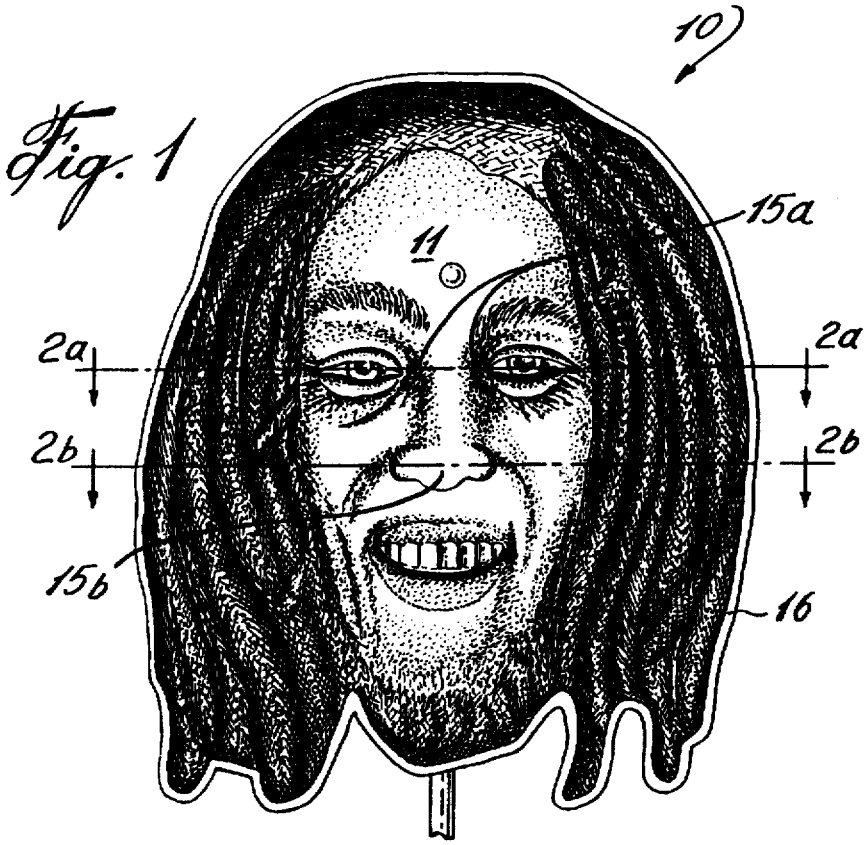
FIG. 1 is a front view of the negative image-forming surface according to the preferred embodiment as it would appear from a very close distance without observing the optical illusion in which it can be seen that portions of the surface which are raised are made darker in shade and portions of the surface which are sunken are made lighter in order to enhance the effect of the optical illusion.
Figure 3:
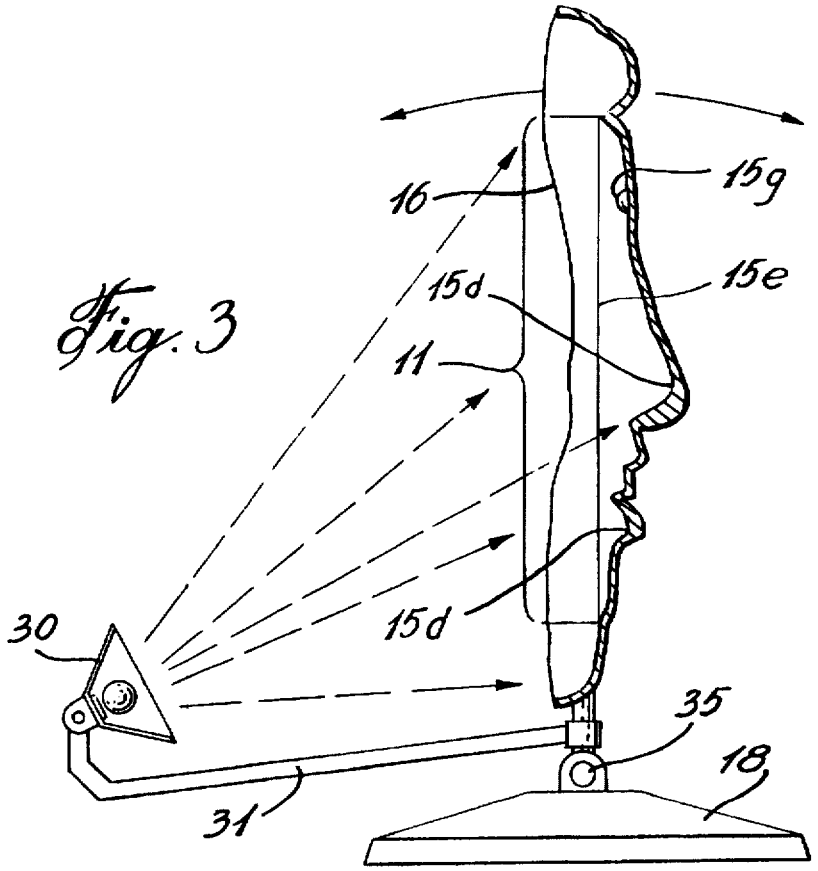
FIG. 3 illustrates a vertical section about a plane of symmetry of the device shown in FIG. 1 with the addition of the illumination lamp showing how the vertical profile of the nose relief is altered to respect the illumination angle without creating any harmful shadowing which may obstruct proper viewing, while controlling enough shadow for 3D enhancement, and which is mounted on a pivot base.

As shown in FIG. 1, the optical illusion device 10 in the preferred embodiment comprises a metal substrate having a negative image forming surface 11 which represents the face and hair of a person. The device 10 is mounted on a base 18 without any surrounding frame whereby when the surface 11 is illuminated, as illustrated in FIG. 3, in a room having dim light, the image is seen without having the reference of a surrounding frame.

Figure 2A:
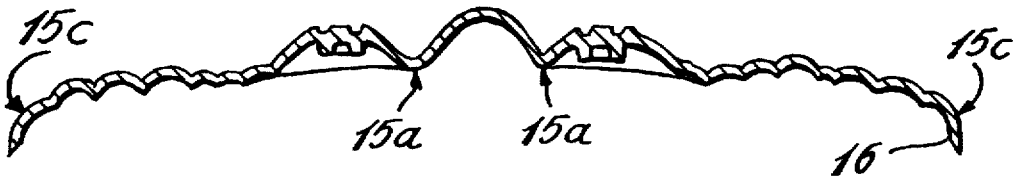
FIG. 2*a* is a horizontal cross-section of the negative shown in FIG. 1 about the eyes and bridge of the nose in which there is shown the raised portions between the eyes and the bridge of the nose which are darkened according to the invention.
Figure 2B:
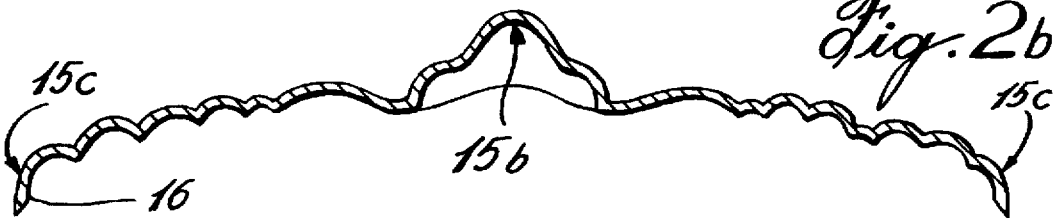
FIG. 2*b* is a horizontal cross-section of the negative shown in FIG. 1 about the nose and cheekbone portion in which there is shown the depth of relief due to the nose as well as the darkened edge and corresponding edge portion on the positive side so that when the negative is viewed from an oblique angle, the edge of the positive does not interfere with viewing the image on the negative side.

As can be seen in FIG. 1, the surface 11 is provided with shading which is contrary to the actual image being viewed. This altered shading serves to darken surfaces at a higher relief and lighten surfaces at a greater relief. As illustrated in FIGS. 2*a* and 2*b*, as well as in FIG. 1, the relatively raised relief portions at 15*a* are made darker than would be the normal coloring to represent the image and the portion of the surface 11 at 15*b*, as illustrated in FIG. 2*b* and in FIG. 1, is made substantially lighter than would be under conditions of normal coloration to represent the image. The resulting effect provides an enhanced optical illusion image of the three-dimensional form when viewed.

As can be appreciated from FIGS. 1, 2*a*, 2*b* and 3, in the preferred embodiment, the positive side of the device 10 is sculpted so that when the object is viewed from the positive side, a realistic and pleasant representation of the represented object is shown.

In the preferred embodiment, the surfaces 15*c* of the peripheral edge 16 of the object 10 are darkened so that they do not interfere with the image being presented when viewed at an oblique angle. This works well for objects whose positive side are made dark or have a dark object around the perimeter as would be the case for the object illustrated in FIG. 1. It has been found suitable to provide color to the surface 11 to create a realistic optical illusion image of the object represented by the negative surface 11, while on the positive side, to make the surface uniformly one color since, like most sculptures, it is to be admired for its form and detail while coloration is less important.

As can be appreciated, when the object 10 is viewed with the lamp as illustrated in FIG. 3 in a room with dim lighting conditions, the fact that the peripheral edge 16 of the object 10 follows the contour of the object represented by surface 11, allows the image of the object to be seen without any distracting frame or reference.

Furthermore, as illustrated in FIG. 3, it will be noted that the surfaces 15*d* have been altered in angle with respect to the actual image being presented with a view to raising the angle of such surfaces to catch light from lamp 30.

Lamp 30 is mounted on a stem 31 to the base 18 and the object 10 is mounted to base 18 at a pivot joint 35. By using the pivot joint 35, the angle of inclination of surface 11 with respect to the surface on which it stands can be adjusted to present the desired or optimal visual effect. Thus, if the base 18 is to rest on top of a bookshelf, it may be desirable to incline the object 10 in the direction of the viewer to provide the greatest visual effect when viewed from below, while if the base 18 rests on a coffee table or lower shelf of a bookcase, it may be desirable to incline object 10 away from the viewer so that it can be viewed from above. It is to be noted that the image seen when viewing surface 11 moves as the viewer changes position from left to right as well as up and down. Thus, it may be desirable to adjust the position of object 10 using the pivot 35 from time to time so as to change the image seen. The arm 31 of lamp 30 is also connected to the pivot joint 35 preferably so as to move with object 10.

It is possible to mount a positive decorative article, such as 15*g*, to the negative image-forming surface. The positive article 15*g* may be a semi-precious stone, an appliqué or the like. Preferably, the positive article is brighter than the negative image forming surface 11. The positive article appears as a positive object image mounted in the image seen in the negative surface, and not, as might be expected, as an inverted (i.e. negative) image. As an example of such a positive article, a stone mounted on a headband or a turban portion of the negative image forming surface would appear as a positive image of the stone on the image of the head band or turban.

Figure 2C:
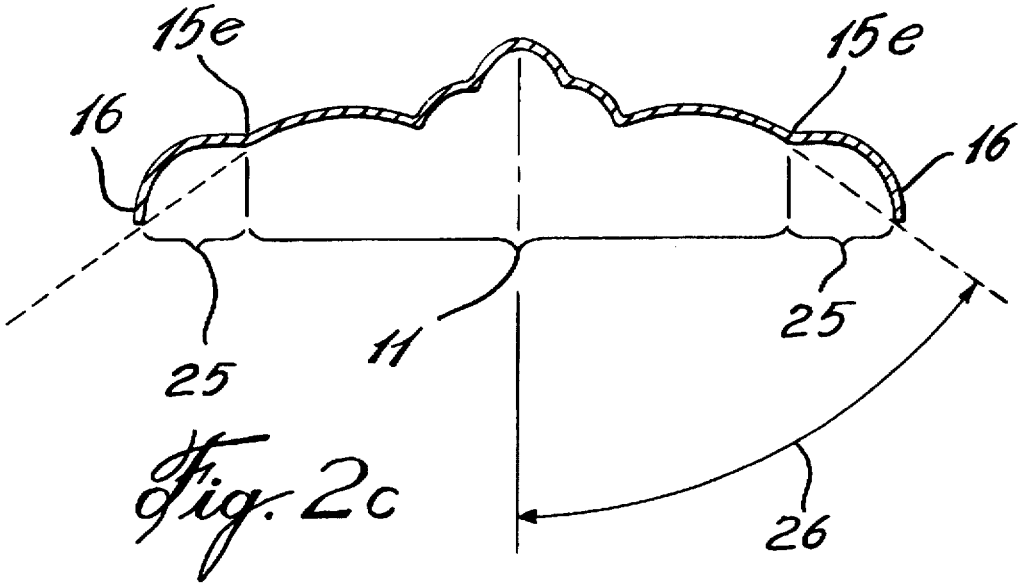
FIG. 2*c* is a cross-section similar to the cross-section in FIG. 2*a* in which the negative surface includes a peripheral portion in addition to the main facial portion on each side of the main facial portion, the peripheral portion forming a second concave negative surface having a peripheral edge shaped with the intent to make the image associated with the peripheral surface disappear when viewed from an increasingly oblique angle.

In FIG. 2*c*, there is shown a cross-section of an object similar to the object 10 illustrated in FIG. 1 in which peripheral portions 25 and 25' are provided on each respective side of a main portion of the surface 11. The peripheral portions 25 contain features of the object whose image is to be viewed which are normally adjacent but associated with the main object. In the case of a human face, the peripheral portion may contain the negative relief image-forming surface for the hair, ears or the like of the person. In the case of an object or a scenery, the peripheral portion may simply be part of a background or auxiliary object. In FIG. 2*c*, there is shown a line defining the maximum viewing angle 26 which is the maximum angle at which the main surface 11 may be viewed and see an integral image. This angle may be defined by the maximum angle of curvature of surface 11 although a realistic image may still be seen at angles which extend somewhat beyond this angle. In the illustration in FIG. 2*c*, the angle 26 is shown as the angle extending from the curvature of the surface 11 at its boundary 15*e* with the peripheral surfaces 25. The outer edge 27 thus eclipses vision of the peripheral surface 25 when viewed from the maximum viewing angle 26 for each respective side.

As can be further appreciated from FIG. 2*c*, as the viewer reaches the maximum viewing angle 26, the outer edge 16 of the peripheral portion 25 from the side 15*e* of the surface 11 is being viewed eclipses any image which could be seen on the surface 25 on such side, while the image seen in the peripheral portion 25 on the opposite side of main portion 11 is completely exposed, as should be the case with the object being viewed. This gives rise to the particular shape of the outer edge 16 of the peripheral portion 25 as can be seen in the vertical section of FIG. 3.

As the surface 11 and 25 is viewed from an oblique frontal viewing angle to the extreme angle 26, the viewer sees an evolution of the image from a frontal image to a profile image. The viewing angle is thus extended to this profile which without the provision of the peripheral portion 25 and the dual concave structure of the negative image forming surface would otherwise be within a distortion area. It will be noted that the peripheral portion 25 nearest to the viewer as the viewer views the image from the front to the profile will provide a gradually reducing image of the corresponding peripheral part of the object whose image is formed by viewing surface 11. It will be further noted that the peripheral portion 25 farthest from the viewer as the viewer views the image from the front to the profile will provide a gradually increasing image of the corresponding peripheral part of the object whose image is formed by viewing surface 11. Of course, the peripheral portion 25 need only be provided on one edge of the main portion 11, in accordance with the requirements of the particular object whose image is formed by surface 11. This edge may be the upper, lower or any lateral edge.

Figure 4:
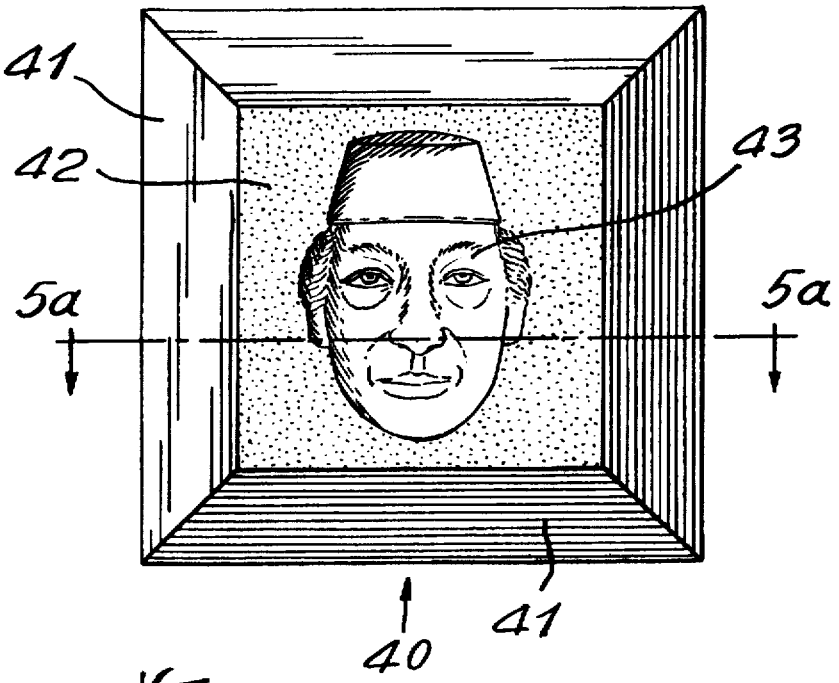
FIG. 4 illustrates an embodiment of the invention in which the illusion device is made of a translucent material and is provided on a frame having a dark contrasting border which extends rearwardly towards a mounting plane.
Figure 5A:
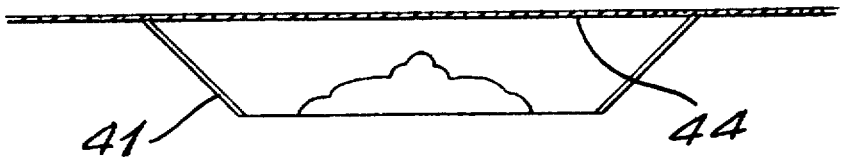
FIG. 5*a* illustrates the embodiment of FIG. 4 in a horizontal cross-section shown mounted to a window.
Figure 5B:
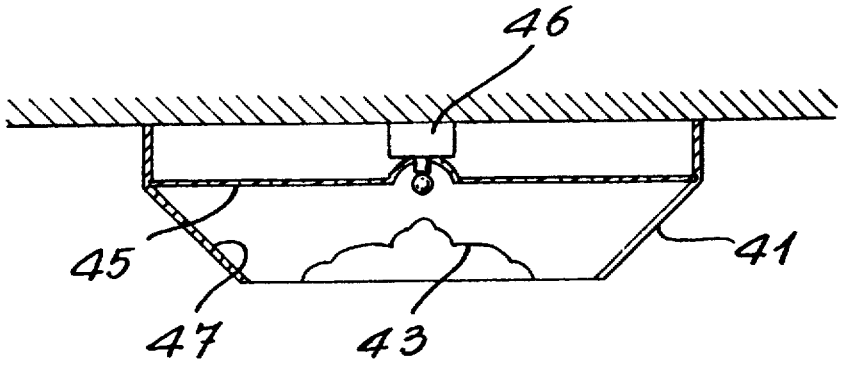
FIG. 5*b* illustrates the embodiment of FIG. 4 mounted to a reflective back plate and including an illumination lamp.

In FIGS. 4 and 5, there is shown an embodiment in which a negative relief image forming surface 43 is provided in a translucent plastic substrate 42 which is integrally connected with a frame 40. The frame 40 consists of a black or otherwise darkened peripheral panel 41. In this embodiment, the negative surface 43 can be mounted to a window 44 as illustrated in FIG. 5*a* by virtue of the backwards slanted panels 41. The panels 41 may be integrally formed with the colored sheet of plastic providing surfaces 42 and 43. Such a thin plastic sheet may be vacuum formed after color printing of the image on surface 43. Darkening of the surfaces 41 and 42 may be applied separately after vacuum forming or they may be applied prior to vacuum forming. In the embodiment illustrated in FIG. 5*b*, the frame 40 is mounted to a wall and includes a panel 45 which guides light from a lamp 46 to be uniformly provided to the rear surface of the negative 43. Preferably, the surface 45 and the interior surface of side panels 41 illustrated as surfaces 47 are made reflective (either silvered or diffusely made bright white).

Figure 6:
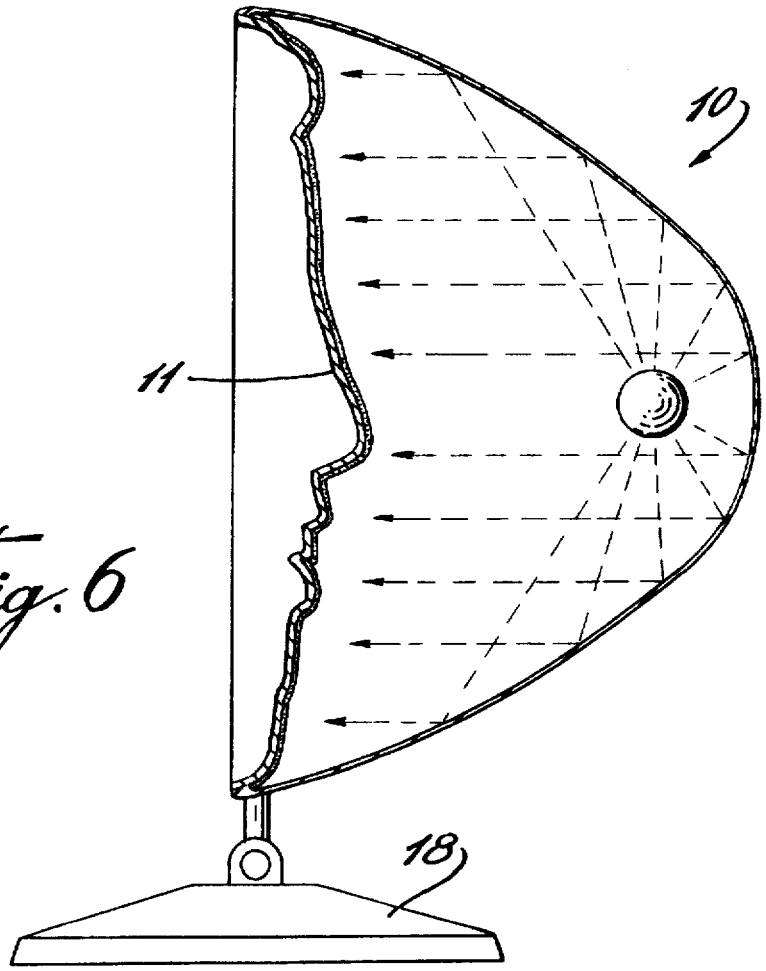
FIG. 6 shows an embodiment of the invention in which a rear illuminated translucent negative image-forming surface is shown in vertical cross-section as mounted to a base in which the full contour of the surface 11 matches the light containment housing at the rear.

As can be appreciated, the shape of the frame 40 can be adapted to the surface on which it is to be mounted. For example, if the object is to be mounted onto a cylindrical lampshade or a conical lampshade, then the shape of the frame means 40 is adjusted accordingly. In the embodiment illustrated in FIGS. 4 and 5, there is provided a flat portion 42 surrounding the negative image portion 43 which may be made of a background color or image or may be made to be dark. As can be appreciated, it is also possible when manufacturing the frame means 40 with the image surface 43 to have the frame panels 41 shaped to join substantially continuously with the perimeter of the edge of the surface 43. In FIG. 6, an embodiment is illustrated in which a rear lit translucent surface 11 is illuminated by a rear illumination lamp which is integrally connected with the surface 11 and mounted onto the base 18. Preferably, the enclosure for the lamp is light reflective on its interior surface and the surface 11 acts as a diffuser to provide even illumination of the surface 11.

What is claimed is:

1. An optical illusion device comprising:

a substrate having a negative image-forming surface; and a shading coloration applied to said surface, said coloration corresponding to a shape of said negative image-forming surface such that portions of said surface which are more recessed are generally made lighter in shade and portions of said surface which are less recessed are generally made darker in shade, whereby perception of a three-dimensional image is enhanced without generating shade variation artifacts in the image perceived.

2. The device as claimed in claim 1, further comprising a light source for illuminating said negative surface.

3. The device as claimed in claim 1, wherein said negative surface has an altered shallow depth which prevents image formation loss at oblique angles.

4. The device as claimed in claim 1, wherein a color image is applied to said negative surface.

5. An optical illusion device comprising:

a substrate having a negative image-forming surface and an opposed corresponding positive image-sculpted surface, said substrate having a variable thickness as a result of said negative image forming surface having a different topology from a topology of said positive image-sculpted surface; and a display mount means for mounting said substrate such that said negative surface and said positive surface can be viewed.

6. The device as claimed in claim 5, wherein a positive decorative article is mounted to said negative image-forming surface, whereby said article appears as a positive object mounted on said image seen in said negative surface.

7. An optical illusion device comprising:

a substrate having a negative image-forming surface and a peripheral edge surrounding said image forming surface; and means for mounting said substrate such that said edge is substantially exposed and visible from oblique angles;

said peripheral edge appearing non-obstructive to a perception of an image coming from said surface when viewed substantially obliquely, whereby the image coming from said surface appears substantially free of a surrounding frame and maintains its own contour.

8. The device as claimed in claim 7, wherein said peripheral edge of said substrate is a thin edge.

9. The device as claimed in claim 7, wherein a positive decorative article is mounted to said negative image-forming surface, whereby said article appears as a positive object mounted on said image seen in said negative surface.

10. An optical illusion device comprising:

a substrate having a negative image-forming surface; and a light source for projecting light onto said surface from a position substantially unobstructive to viewing said surface from a predetermined angle; wherein:

said negative surface is formed in an altered manner to control light shadows resulting from light from said light source being blocked by parts of said surface from reaching other parts of said surface, whereby said light source illuminates said surface with controlled shadows.

11. The device as claimed in claim 10, wherein said substrate further comprises an opposed corresponding positive image-sculpted surface, said positive surface being formed substantially without said altered manner, whereby features in said positive surface, which correspond to features which are altered in said negative to control shadows due to the angle of illumination, are sculpted in a normal fashion to give a normal appearance.

12. The device as claimed in claim 10, wherein a positive decorative article is mounted to said negative image-forming surface, whereby said article appears as a positive object mounted on said image seen in said negative surface.

13. An optical illusion device comprising:

a substrate having a negative image-forming surface comprising a main portion and a peripheral portion, said main and peripheral portions providing a composite image when viewed from moderate angles in a viewing plane; wherein:

said peripheral portion has an edge with respect to a periphery of said surface;

said main portion has an edge with respect to said peripheral portion and a maximum image viewing angle in said plane when viewed from a side of said surface on which said peripheral portion is located; and said edge of said peripheral portion has a relief with respect to said edge of said main portion so as to block substantially an image of said peripheral portion when viewed from said maximum image viewing angle.

14. The device as claimed in claim 13, wherein a positive decorative article is mounted to said negative image-forming surface, whereby said article appears as a positive object mounted on said image seen in said negative surface.

15. An optical illusion device comprising:

a substrate having a negative image-forming surface, wherein said substrate is mounted with an adjustable angle of inclination about a horizontal axis; and a shading coloration applied to said surface, said coloration corresponding to a shape of said negative image-forming surface such that portions of said surface which are more recessed are generally made lighter in shade and portions of said surface which are less recessed are generally made darker in shade, whereby perception of a three-dimensional image is enhanced without generating shade variation artifacts in the image perceived.

16. An optical illusion device comprising:

a substrate having a negative image-forming surface; and a light source for protecting light onto said surface from a position substantially unobstructive to viewing said surface from a predetermined angle; wherein:

said negative surface is formed in an altered manner to control light shadows resulting from light from said light source being blocked by parts of said surface from reaching other parts of said surface, whereby said light source illuminates said surf ace with controlled shadows;

said substrate comprises a peripheral edge surrounding said image-forming surface;

said substrate is mounted by mounting means such that said edge is substantially exposed;

said peripheral edge appears non-obstructive to a perception of an image coming from said surface when viewed substantially obliquely, whereby the image coming from said surface appears substantially free of a surrounding frame and maintains its own contour; and said light source is arranged to project light onto an area greater than an area of said surface such that a shadow of said edge is cast.

17. An optical illusion device comprising:

a substrate having a negative image-forming surface;

a positive decorative article mounted to said negative image-forming surface, whereby said article appears as a positive object mounted on said image seen in said negative surface; and a shading coloration applied to said surface, said coloration corresponding to a shape of said negative image-forming surface such that portions of said surface which are more recessed are generally made lighter in shade and portions of said surface which are less recessed are generally made darker in shade, whereby perception of a three-dimensional image is enhanced without generating shade variation artifacts in the image perceived.

* * * * *